United States Patent [19]

Andersen

[11] Patent Number: 4,528,538

[45] Date of Patent: Jul. 9, 1985

[54] COMBINED SWITCH AND CIRCUIT BREAKER

[76] Inventor: James H. Andersen, P.O. Box 637, Mercer Island, Wash. 98040

[21] Appl. No.: 570,393

[22] Filed: Jan. 13, 1984

[51] Int. Cl.[3] ..... H01H 73/30

[52] U.S. Cl. ..... 337/43; 337/2

[58] Field of Search ..... 337/1, 2, 3, 12, 13, 337/42, 43, 66, 72, 56, 89, 35; 335/1, 13, 14

[56] References Cited

U.S. PATENT DOCUMENTS 3,569,888 3/1971 Taylor ..... 337/89

4,068,203 1/1978 Unger ..... 337/56

4,330,772 5/1982 Hastings et al. ..... 337/43

*Primary Examiner*—Harold Broome

*Attorney, Agent, or Firm*—Christensen, O'Connor, Johnson & Kindness

[57] ABSTRACT

A combined switch and circuit breaker device. The circuit breaker includes trip means for interrupting current flow when the current exceeds a predetermined level and for preventing the resumption of current flow until the trip means is reset. The device is adapted such that after interruption of current flow by the trip means, opening the switch resets the trip means.

9 Claims, 4 Drawing Figures

COMBINED SWITCH AND CIRCUIT BREAKER

BACKGROUND OF THE INVENTION

The present invention relates generally to electrical switches and electrical circuit breakers, and more particularly to a combination switch and circuit breaker adapted such that actuation of the switch resets the circuit breaker.

Circuit breakers are used in a wide variety of electronic systems in which sensitive components must be protected from large currents such as those that may be caused by circuit malfunctions or external power surges. A circuit breaker is connected between the source of power and the components to be protected, and contains an element that trips when excessive current flows through it, opening the circuit through the circuit breaker and disconnecting the source of power from the components to be protected. Devices containing circuit breakers commonly include an on/off switch connected in series with the circuit breaker for activation and deactivation of the electronic device by a user. When the circuit breaker trips, the user preferrably turns the switch to its off (open) position, resets the circuit breaker, and then returns the switch to its on (closed) position. If the condition which tripped the circuit breaker is still present, the circuit breaker will trip again after the switch is closed.

It is one object of the present invention to provide a combined switch and circuit breaker that is more convenient to operate when the circuit breaker has been tripped. In particular, it is an object of the present invention to reduce the three distinct actions listed above, i.e., (1) opening the switch; (2) resetting the circuit breaker; and (3) closing the switch, to two actions by providing a circuit breaker in which opening the switch after the circuit breaker has been tripped will simultaneously reset the circuit breaker.

It is a further object of the present invention to provide a combined switch and circuit breaker that can conveniently be packaged within the same housing, to thereby save the space that would otherwise be occupied by separate housing for these units.

SUMMARY OF THE INVENTION

Accordingly, the foregoing objects and other objects are achieved by the present invention which provides a combination switch and circuit breaker device comprising a circuit breaker including trip means for interrupting current flow through the circuit breaker in response to the current flow exceeding a predetermined level and for subsequently preventing resumption of current flow until the trip means in reset, and a switch connected in series with the circuit breaker. The switch includes a switch element movable between first and second positions in which the switch is respectively open and closed. The device is adapted such that after interruption of current flow by the trip means, the trip means is reset when the switch element is moved to its first position.

In a further aspect of the present invention, the trip means comprises contact means movable between a closed position in which current can flow through the circuit breaker and an open position in which current cannot flow through the circuit breaker, means for causing the contact means to move from the closed position to the open position in response to excessive current flowing through the circuit breaker, and means for preventing the contact means from moving from the open position to the closed position until the trip means is reset.

In another aspect of the invention, the means for preventing the contact means from moving from the open to the closed position comprises an insulating member movable between a blocking position in which it prevents the contact means from moving to the closed position, and a nonblocking position in which it does not prevent the contact means from moving to the closed position. In this aspect, movement of the switch element to its first position after interruption of current flow by the trip means causes the insulating member to move to its nonblocking position, thereby resetting the trip means.

In a further aspect of the invention, the means for causing the contact means to move from the closed position to the open position comprises a thermally sensitive bimetallic sheet having a tongue released therefrom, the contact means being mounted on the tongue.

These and other features, objects and advantages of the invention will become apparent from detailed description and claims to follow, taken in conjunction with the accompanying drawings.

DETAILED DESCRIPTION OF THE INVENTION

Figure 1:
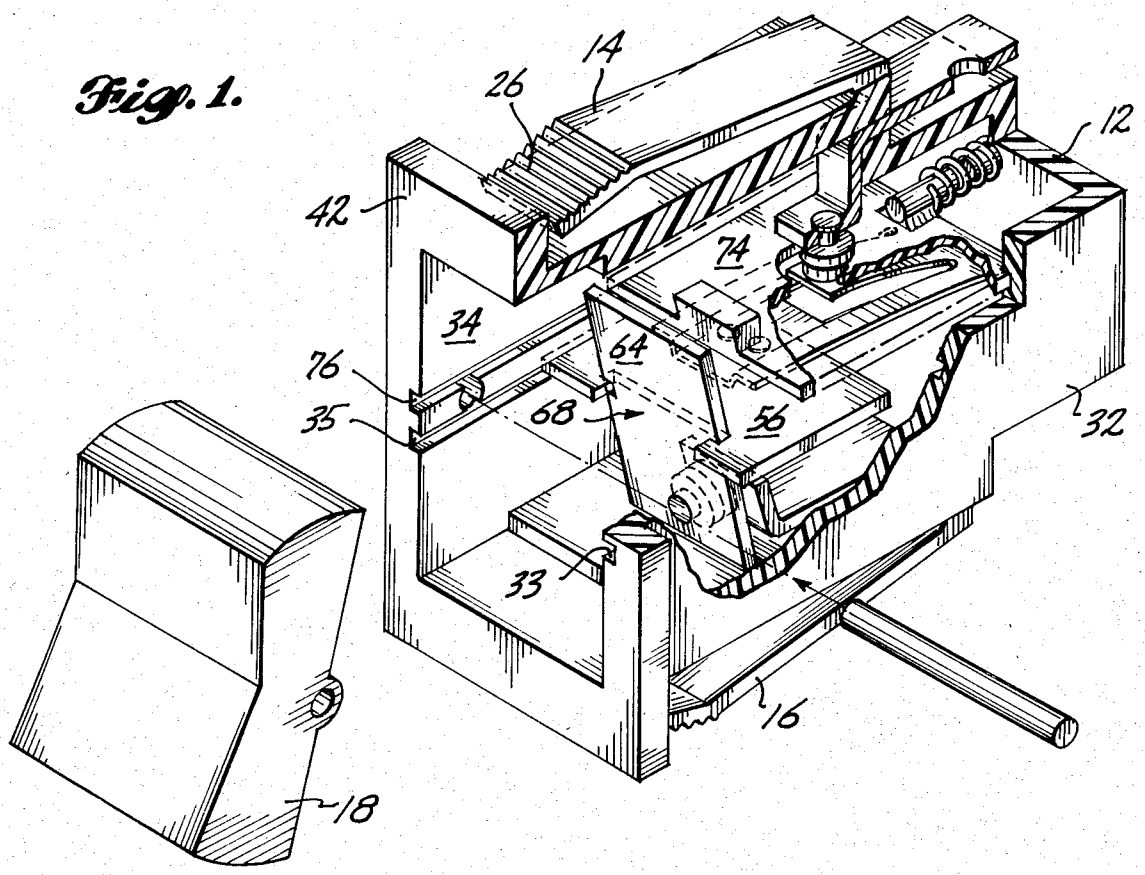
FIG. 1 is an isometric view of the combined switch and circuit breaker, with portions exploded and broken away.
Figure 2:
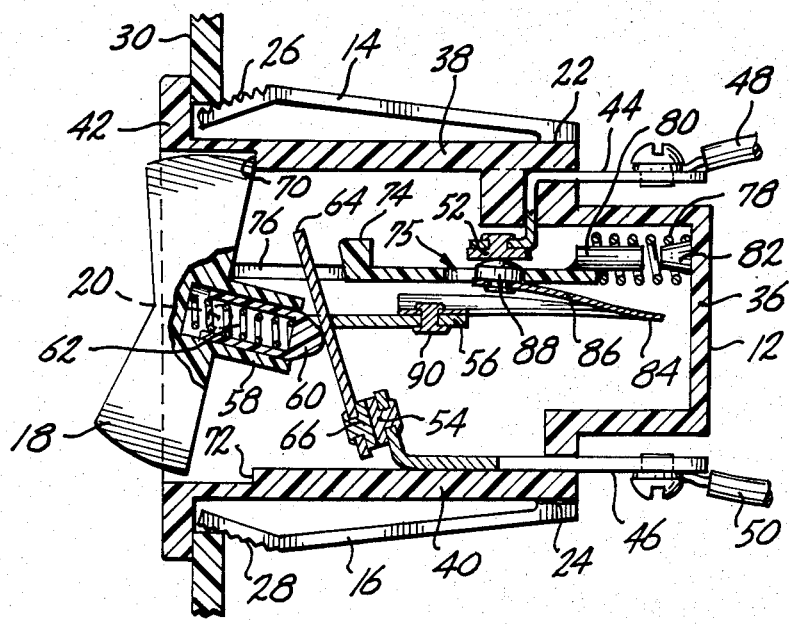
FIG. 2 is a longitudinal sectional view showing the switch in its on position and the circuit breaker not tripped.

Referring first to FIGS. 1 and 2, one preferred embodiment of the combined switch and circuit breaker device is shown comprising an insulating housing 12, upper and lower mounting brackets 14 and 16, and rocker arm 18 pivotably mounted to housing 12 by pin 20. As described below, rocker arm 18 provides the means for turning the switch on and off, as well as for resetting the circuit breaker. Housing 12 includes sidewalls 32 and 34, rear wall 36, and stepped upper and lower walls 38 and 40.

Upper and lower mounting brackets 14 and 16 are resilient arms having toothed forward ends 26 and 28 respectively, and whose respective opposite ends 22 and 24 are attached to housing 12. The housing includes a forwardly mounted flange 42 that serves in combination with the mounting brackets to mount the device in mounting panel 30. In particular, when mounting brackets 14 and 16 are forced together towards housing 12, the device may be inserted through an opening in mounting panel 30 until flange 42 abuts the outer face of the mounting panel. Mounting brackets 14 and 16 are then released and forward ends 26 and 28 engage the mounting panel and secure the device.

Referring now to FIG. 2, the combined switch and circuit breaker device of the present invention includes upper and lower terminals 44 and 46 which may be connected to electrically conductive lines 48 and 50, respectively, to connect the device to other electrical components. The device of the present invention operates to electrically connect lines 48 and 50 when its switch is closed and its circuit breaker is not tripped. The electrical connection between lines 48 and 50 is broken when the switch is moved to its off position (FIG. 3), or when the circuit breaker is tripped (FIG. 4).

Upper terminal 44 passes through the stepped section of upper wall 38, and terminates in electrical contact 52. Lower terminal 46 passes through the stepped section of lower wall 40, and terminates in electrical contact 54. Electrically conductive plate 56 is mounted between sidewalls 32 and 34 of housing 12, the lateral edges of plate 56 being rigidly mounted in grooves 33 and 35 in the respective sidewalls (FIG.1). Rocker arm 18 is pivotally mounted between sidewalls 32 and 34 by pin 20. Rocker arm 18 includes a rearwardly projecting cylindrical stem 58, within which bullet shaped insert 60 is slidably mounted. Insert 60 is preferrably composed of insulating material and is resiliently biased by spring 62 such that the insert tends to move out of stem 58 towards plate 56. Conductive arm 64 is mounted between insert 60 and plate 56, and terminates at its lower end in electrical contact 66. Referring to FIG. 1, plate 56 includes a forward facing cut-out section 68 within which arm 64 is pivotably mounted by means of notches on the sides of the arm.

Figure 3:
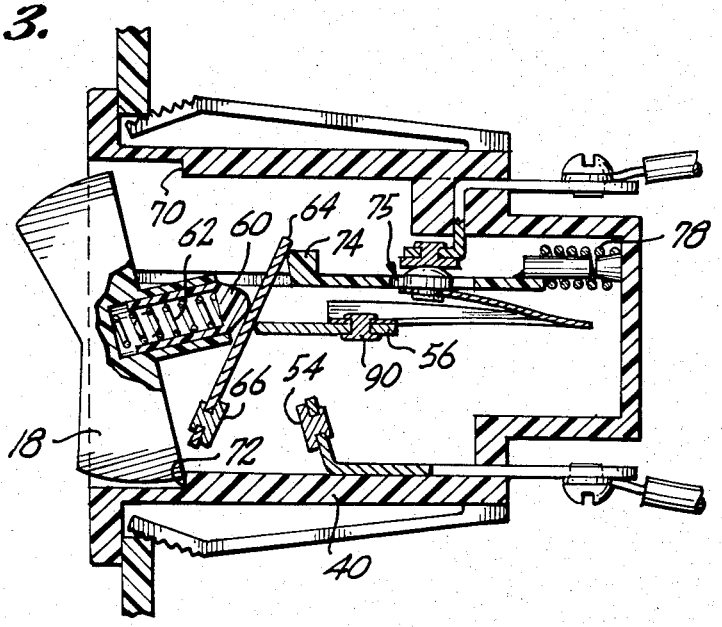
FIG. 3 is a longitudinal sectional view showing the switch in its off position and the circuit breaker not tripped.
Figure 4:
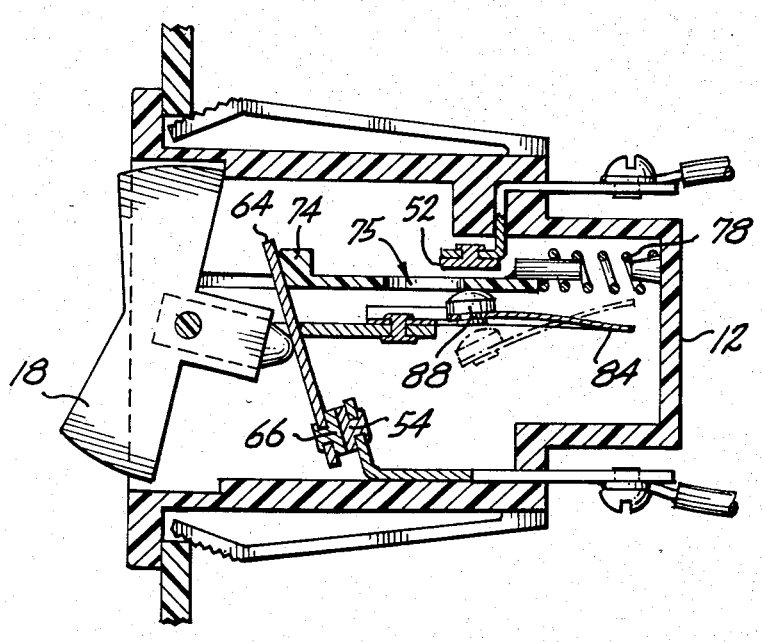
FIG. 4 is a longitudinal sectional view showing the switch in its on position and the circuit breaker tripped.

Referring now to FIGS. 2 and 3, it can be seen that actuation of rocker arm 18 causes arm 64 to move between a first position, shown in FIG. 3, in which contacts 54 and 66 are open, and a second position, shown in FIG. 2, in which contacts 54 and 66 are closed. In FIG. 2, rocker arm 18 has been rotated in a clockwise direction such that the upper portion of the rocker arm abuts stop 70 in upper wall 38. In this position, insert 60 is below the level of plate 56, and the force exerted by spring 62 tends to rotate arm 64 in a counterclockwise direction, pressing contacts 54 and 66 together. In FIG. 3, rocker arm 18 has been rotated in a counterclockwise direction such that the lower portion of rocker arm 18 abuts stop 72 in lower wall 40. In this position, the force exerted by spring 62 through insert 60 rotates arm 64 in a clockwise direction, separating contacts 54 and 66.

The circuit breaker of the present device includes insulating plate 74, bimetallic element 84, and contact 88. Insulating plate 74 is slidably mounted within identical grooves in sidewalls 32 and 34, the groove in sidewall 34 being designated by numeral 76. The insulating plate is biased in a forward direction towards rocker arm 18 by spring 78 mounted between the insulating plate and rear wall 36 of housing 12. Guide pins 80 and 82 are attached to insulating plate 74 and rear wall 36, respectively, and prevent buckling of spring 78 when the spring is compressed. Opening 75 is provided in insulating plate 74 to permit contact 88 to abut contact 52. In the configuration shown in FIG. 2, contact 88 prevents insulating plate 74 from being moved to the left by spring 78.

Thermally sensitive bimetallic element 84 is mounted in a cantilevered fashion by plate 56, and projects in a generally rearward direction from plate 56 towards rear wall 36. Bimetallic element 84 comprises a bimetallic sheet from which a U-shape section has been cut out to define a central tongue 86 upon which contact 88 is mounted. Bimetallic elements of this type are well known to those skilled in the art, and are sometimes referred to as Taylor bimetallic blades. Bimetallic element 84 is secured at the base of the U-shape cutout to plate 56 by rivet 90. Other known fastening means could be used in place of rivet 90.

OPERATION

The operation of the combined switch and circuit breaker device will now be described with reference to FIGS. 2–4. FIG. 2 shows the device configured in its normal operating position with the switch formed by contacts 54 and 66 closed and the circuit breaker in an untripped, conducting position. In the configuration shown in FIG. 2, bimetallic element 84 urges contact 88 against contact 52, and a conductive path is formed from terminal 44 through contact 52, contact 88, bimetallic element 84, plate 56, arm 64, contact 66, contact 54, and terminal 46.

To open the switch, an operator rotates rocker arm 18 to the position shown in FIG. 3. As previously described, counterclockwise rotation of rocker arm 18 causes insert 60 to rotate arm 64 in a clockwise direction, separating contacts 54 and 66 and opening the switch. Subsequent rotation of rocker arm 18 in a clockwise direction will return the switch to the closed configuration shown in FIG. 2.

Current that flows through the device when the switch is closed, as shown in FIG. 2, passes through bimetallic element 84. When the current through the bimetallic element exceeds a predetermined threshold, the heat caused by current will cause the bimetallic element to abruptly snap into a tripped position, indicated by the phantom lines in FIG. 4. In this position, contact 88 is separated from contact 52, and current flow through the device is interrupted despite the fact that the switch comprising contacts 54 and 66 is still closed. Downward movement of contact 88 allows insulating plate 74 to move in a leftward direction in response to the force exerted by spring 78, until its enlarged forward section abuts arm 64. Since current flow through the device has now ceased, bimetallic element 84 will start to cool down, and when it has cooled sufficiently, it will attempt to snap back into the position shown in FIG. 2. However, because of the intervening movement of insulating plate 74, contact 88 mounted to bimetallic element 84 is prevented from moving upwards and abutting contact 52, and is blocked by insulating plate 74 in the position shown by the solid lines in FIG. 4. The device will remain in the FIG. 4 configuration until the circuit breaker is reset.

Resetting of the circuit breaker, and opening of the switch, is accomplished by a single counterclockwise rotation of rocker arm 18 to the configuration shown in FIG. 3. Such motion of rocker arm 18 opens the switch formed by contacts 54 and 66 as previously described, and simultaneously forces insulating plate 74 to the right, compressing spring 78. The rightward motion of insulating plate 74 positions opening 75 over contact 88, permitting contact 88 to move upwards under the force exerted by bimetallic element 84 until contact 88 abuts contact 52. The circuit breaker has now been reset. The switch may subsequently be closed by rotation of rocker arm 18, as previously described.

While the preferred embodiments of the invention have been illustrated and described herein, it should be understood that variations will be apparent to those skilled in the art. Accordingly, the invention is not to be limited to the specific embodiments illustrated and described herein, and the true scope and spirit of the invention are to be determined by reference to the appended claims.

The embodiments of the invention in which an exclusive property or privilege is claimed are defined as follows:

1. A device comprising:

a circuit breaker including trip means for interrupting current flow through the circuit breaker in response to said current flow exceeding a predetermined level and for subsequently preventing the resumption of current flow through the circuit breaker until the trip means is reset; and a switch connected in series with the circuit breaker, the switch including a switch element movable between a first position in which the switch is open and a second position in which the switch is closed, the switch being constructed and arranged such that after interruption of current flow by the trip means, moving the switch element to the first position first opens the switch and then resets means to permit current flow through said circuit breaker.

2. The device of claim 1, wherein the trip means comprises contact means movable between a closed position in which current can flow through the circuit breaker and an open position in which current cannot flow through the circuit breaker, means operably associated with the contact means for causing the contact means to move from the closed position to the open position in response to excessive current flow through the circuit breaker, and means operably associated with the contact means for preventing the contact means from moving from the open position to the closed position until the trip means is reset.

3. The device of claim 2, wherein the means for preventing the contact means from moving from the open position to the closed position comprises an insulating member mounted such that it is movable between a blocking position in which it prevents the contact means from moving to the closed position and a nonblocking position in which it does not prevent the contact means from moving to the closed position, and means for resiliently biasing the insulating member towards the blocking position.

4. The device of claim 3, wherein the insulating member and the switch element are so mounted such that movement of the switch element to the first position after interruption of current flow by the trip means causes the insulating member to move to the nonblocking position.

5. The device of claim 2, wherein the means for causing the contact means to move from the closed position to the open position comprises a thermally sensitive bimetallic sheet having a tongue released therefrom, the contact means being mounted on the tongue.

6. The device of claim 1, wherein the switch comprises a conductive element movalbe between a first position in which the switch is open and a second position in which the switch is closed, the device being adapted such that after interruption of current flow by the trip means, moving the conductive element to the first position resets the trip means.

7. The device of claim 6, wherein the trip means comprises contact means movable between a closed position in which current can flow through the circuit breaker and an open position in which current cannot flow through the circuit breaker, means for causing the contact means to move from the closed position to the open position in response to excessive current flow through the circuit breaker, an insulating member mounted such that it is movable between a blocking position in which it prevents the contact means from moving to the closed position and a nonblocking position in which it does not prevent the contact means from moving to the closed position, and means for resiliently biasing the insulating member towards the blocking position.

8. The device of claim 7, wherein the insulating member and the conductive element are so mounted such that movement of the conductive element to the open position after interruption of current flow by the trip means causes the insulating member to move to the nonblocking position.

9. The device of claim 8, wherein the means for causing the contact means to move from the closed position to the open position comprises a thermally sensitive bimetallic sheet having a tongue released therefrom, the contact means being mounted on the tongue.

* * * * *

UNITED STATES PATENT AND TRADEMARK OFFICE

CERTIFICATE OF CORRECTION

PATENT NO. : 4,528,538

DATED : July 9, 1985

INVENTOR(S) : James H. Andersen

It is certified that error appears in the above-identified patent and that said Letters Patent is hereby corrected as shown below:

Column 1, line 53, "in" should be --is--
Column 2, line 23, insert --the-- before "detailed"
Column 5, line 21, insert --the trip-- before "means"
Column 6, line 13, "movalbe" should be --movable--

Signed and Sealed this

*Twenty-ninth* Day of *October 1985*

[SEAL]

*Attest:*

DONALD J. QUIGG

*Attesting Officer*

*Commissioner of Patents and Trademarks—Designate*